United States Patent [19]

Lindéen

[11] Patent Number: 5,001,945

[45] Date of Patent: Mar. 26, 1991

[54] SCISSOR SHARPENER

[75] Inventor: Olavi Lindéen, Billnäs, Finland

[73] Assignee: Fiskars Oy Ab, Helsingfors, Finland

[21] Appl. No.: 581,744

[22] Filed: Sep. 13, 1990

[30] Foreign Application Priority Data

Oct. 13, 1989 [FI] Finland ..... 894864

[51] Int. Cl.[5] ..... B21K 11/06; B24B 3/52

[52] U.S. Cl. ..... 76/82.2; 76/82; 51/214; 51/208; 51/181 R

[58] Field of Search ..... 51/72, 181 R, 206 P, 51/208, 214, 212, 285, 84 BS, 82 BS; 76/82.2, 85, 86, 88, 82

[56] References Cited

U.S. PATENT DOCUMENTS

| | | | |
|---|---|---|---|
| 538,964 | 5/1895 | Hermes | 76/82.2 |
| 1,051,333 | 1/1913 | Jacoby | 76/82.2 |
| 2,147,464 | 2/1939 | Shaw | 51/214 |
| 2,404,025 | 7/1946 | Barnes | 76/86 |
| 4,258,592 | 3/1981 | Linden | 76/82.2 |

*Primary Examiner*—Robert A. Rose

*Attorney, Agent, or Firm*—Foley & Lardner

[57] ABSTRACT

The invention relates to a scissor sharpener comprising a grinding element which is passed along the scissor blades between them during sharpening. The blades can be provided with a microscopic transverse toothing if the grinding element is formed by two rolls the rotation of which is prevented when they are passed from the blade point toward the scissor hinge and allowed when they are passed in the opposite direction.

4 Claims, 1 Drawing Sheet

SCISSOR SHARPENER

The present invention relates to a scissor sharpener comprising a body; a grinding element mounted in the body to grind the edge surfaces of scissor blades when the scissor blades are passed over the grinding element; and shaping means arranged in the body so as to be in contact with inner scissor blade surfaces positioned against each other during the sharpening of the scissors to shape the edge of the scissor blades.

U.S. Pat. No. 1,051,333 discloses a scissor sharpener which corresponds to the sharpener described above in its essential parts. The prior art sharpener comprises a plate-like body with two openings for the two scissor blades. A grinding element formed by a round file is positioned in the area between the openings. The blades of the scissors to be sharpened are inserted into the openings of the body and then pressed together similarly as when cutting normally while the sharpener is passed in one or the other direction along the scissor blade. The grinding element thus removes material from the edge surface of the scissors, so that the edge between the edge surface and the inside of the blade becomes sharp.

Since the relative movement between the grinding element and the scissor blades takes place in the longitudinal direction of the blade, the grinding element forms longitudinal grooves in the edge surface of the scissors. This results in that the scissors feel slippery, that is, push the material to be cut, especially synthetic fibre fabric, before them, which hampers the cutting. It is known that transverse grinding does not have this disadvantage, but this grinding direction cannot be achieved by means of the device of the above-mentioned U.S. patent.

GB 2 023 037 discloses a device for sharpening scissors which resembles the prior art device described above. In this case the body is provided with smooth steel pegs which are positioned along the edge of the openings on the side making contact with the edge surfaces and inner surfaces of the scissor blades. Instead of grinding the edge surface the steel pegs merely give the burr of the cutting edge a direction suitable for cutting. This is achieved in such a way that the pegs, which are parallel with the inner blade surfaces, machine the burrs last.

The object of the present invention is to provide a scissor sharpener which is simple and which sharpens the scissors well and in such a way that they do not feel slippery. The scissor sharpener according to the invention is characterized in that the grinding element comprises two rolls which are rotatably mounted in the body and the surface of which is provided with grooves substantially parallel with the central axis of the rolls, and that the sharpener is provided with a locking device arranged to prevent the rotation of the rolls when they move along the scissor blades from the point of the blades towards the scissor hinge and allow the rotation of the rolls when they move in the opposite direction.

In the device according to the invention, the grinding rolls are immovable when the scissors are inserted into the sharpener whereas they rotate when the scissors are withdrawn from the sharpener. In this way a conventional grinding of the edge surfaces is achieved during the first-mentioned grinding step while the surface is toothed or grooved to a certain extent in the transverse direction in the subsequent step. Finally, the burr is shaped suitably by the shaping means mounted in the body. The scissors are sharpened efficiently through these steps, in addition to which the edge surfaces are provided with transverse grooves on account of which the scissors do not feel slippery.

According to a preferred embodiment of the scissor sharpener of the invention, the roll surfaces are in contact with each other. In this way the strain exerted on the roll bearing is smaller than with mutually spaced rolls. The grinding element also becomes lighter, which makes the sharpening easier to carry out.

A simple form of the locking means comprises a spring-loaded wedge positioned in the nip between the rolls.

Since the sharpener is intended for domestic use, it must be reliable and simple to use. This is achieved according to the invention by providing the body with two elongated openings for the scissor blades, one long side of the openings being defined by the elongated shaping means and one short side by the grinding element, whereby the angle between the central line of the shaping means and that of the grinding element is sharp and substantially equal to the angle between the edge surface and the inner surface of the scissor blades.

In the following the preferred embodiment of the scissor sharpener of the invention will be described in greater detail with reference to the attached drawing, in which FIG. 1 is an axonometric view of the scissor sharpener according to the invention;

Figure 1:
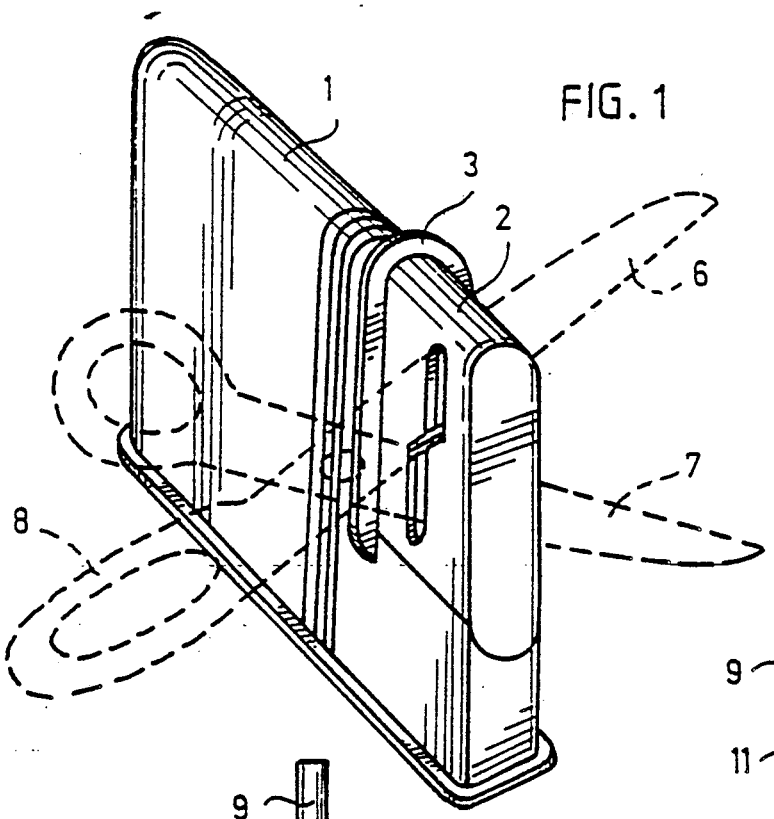

The scissor sharpener shown in the drawing comprises a body 1 made of plastic and having a U-shaped cross-section. A sharpening unit 2 with a protective flange 3 is attached to one end of the body. The sharpening unit is provided with two throughgoing openings 4 and 5 for the scissor blades 6 and 7 of scissors 8, respectively. The openings are elongated and parallel with each other but slightly displaced with respect to each other in the sideward direction so that the blades of the scissors fit in the openings.

Shaping means formed by smooth steel pegs 9 and 10 are arranged to extend along the longer side of each opening 4, 5 on the side making contact with inner blade surfaces 11 facing each other. A grinding element 12 is further arranged in the body in the area between the openings 4, 5 in such a way that an edge surface 13 of the scissor blades makes contact with the grinding element during sharpening. The grinding element is made of a suitable grinding material and its grinding surface forms a sharp angle with the longitudinal axis of the pegs, which angle is substantially equal to the edge angle of the scissor blades, that is, the angle between the surfaces 11 and 13.

According to the invention the grinding element 12 is formed by two rolls 14 and 15 the axes of which are parallel with each other. The rolls are mounted rotatably in bearings in the body. The surface of the rolls is provided with shallow grooves substantially parallel with the central axis of the rolls, and the rolls are positioned so close to each other that they make contact with each other along a line over the width of the grinding surface.

Figure 3:
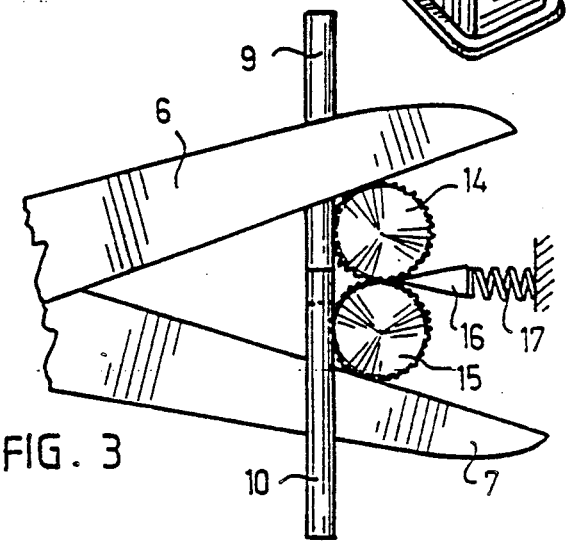
FIG. 3 is a schematic view of one sharpening step seen in the longitudinal direction of the rolls.
Figure 4:
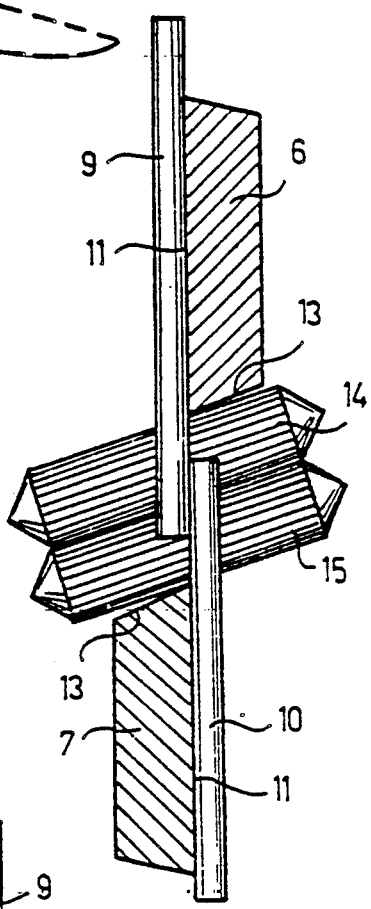
FIG. 4 is a schematic view of the sharpening seen in the cutting direction.
Figure 2:
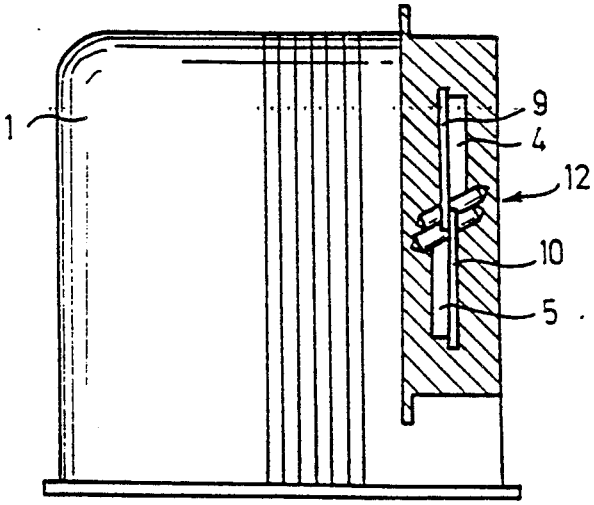
FIG. 2 shows the sharpener partly from the side and partly in section.

The scissor sharpener further comprises a locking device for the rolls. The locking device can be formed in various ways; one possible construction is shown in FIG. 3. In this particular case, the locking device is formed by a wedge 16 the thin edge of which is passed into the nip between the rolls 14, 15 under the influence of the spring force of a compression spring 17. The locking device is arranged on that side of the rolls which faces away from the shaping means 9, 10 and the handle of the scissors.

The scissor sharpener according to the invention is used in the following way. The points of the scissor blades 6, 7 are inserted into the openings 4, 5 of the sharpener while the handle portions are pressed together with a reasonable force similarly as when cutting. The scissor blades are then passed deeper into the openings, whereby the upper roll 14 in FIG. 3 tends to rotate clockwise and the lower roll anticlockwise. The edge of the wedge 16 thereby partly penetrates between the rolls and prevents their rotation, as a result of which the edge surface 13 of the scissor blades is ground by the grinding surfaces of the rolls.

The scissor blades are then withdrawn from the openings in the body, whereby the roll 14 starts to rotate anticlockwise and the roll 15 clockwise because the roll surfaces push the wedge out of the nip. During the withdrawal of the blades, the grooves of the rolls, which are considerably exaggerated in FIG. 3 for the sake of clarity, form a microscopic toothing on the edge surface 13 of the blade and along the edge. In the low areas of the toothing the burr is displaced to the side, so that it protrudes from the inner surface 11 of the scissor blade. This affects adversely the sharpening effect and the sharpener is therefore provided with smooth pegs 9, 10 which at least partially return the burr in level with the inner surface 11 of the scissor blades.

The scissor sharpener of the invention is not restricted to the preferred embodiment described above but it can vary within the scope of the attached claims. Accordingly, the locking device 16, 17 may be of some other shape than that described above, and it can be positioned in the bearing of the roll, for instance. The rolls can be mutually spaced and the grooves can differ in appearance and direction from those shown in the figure.

I claim:

1. A scissor sharpener comprising a body; a grinding element mounted in the body to grind the edge surfaces of scissor blades when the scissor blades are passed over said grinding element; and shaping means arranged in said body so as to be in contact with inner scissor blade surfaces facing each other during the sharpening of the scissors to shape the edge of the scissor blades, said grinding element comprising two rolls which are rotatably mounted in said body, each roll having a surface provided with grooves being substantially parallel with a central axis of said rolls, and the sharpener being provided with a locking device arranged to prevent the rotation of said rolls when they move along the scissor blades from the point of the blades towards the scissor hinge and allow the rotation of said rolls when they move in the opposite direction.

2. A scissor sharpener according to claim 1, wherein said surfaces of said rolls are in contact with each other.

3. A scissor sharpener according to claim 1, wherein said locking device is formed by a spring-loaded wedge positioned in a nip between said rolls.

4. A scissor sharpener according to claim 1, wherein said body comprises two elongated openings for the scissor blades, one long side of said openings being defined by said elongated shaping means and one short side by said grinding element, whereby the angle between the central line of said shaping means and that of said grinding element is sharp and substantially equal to the angle between the edge surface and the inner surface of the scissor blades.

* * * * *

UNITED STATES PATENT AND TRADEMARK OFFICE

CERTIFICATE OF CORRECTION

PATENT NO. : 5,001,945

DATED : March 26, 1991

INVENTOR(S) : OLAVI LINDÉN

It is certified that error appears in the above-identified patent and that said Letters Patent is hereby corrected as shown below:

On the cover page, the inventor's last name should read --Lindén--

Signed and Sealed this

Twenty-ninth Day of September, 1992

*Attest:*

DOUGLAS B. COMER

*Attesting Officer*

*Acting Commissioner of Patents and Trademarks*